US011592013B2

(12) United States Patent
Verdugo et al.

(10) Patent No.: US 11,592,013 B2
(45) Date of Patent: Feb. 28, 2023

(54) SINGLE PISTON FOUNDATION BAG-IN-BOX (BIB) PUMP

(71) Applicant: FLOW CONTROL LLC., Beverly, MA (US)

(72) Inventors: Christopher H. Verdugo, Yorba Linda, CA (US); Manuel Villagomez, Corona, CA (US); Humberto V. Meza, Trabuco Canyon, CA (US)

(73) Assignee: FLOW CONTROL LLC, Beverly, MA (US)

( * ) Notice: Subject to any disclaimer, the term of this patent is extended or adjusted under 35 U.S.C. 154(b) by 0 days.

(21) Appl. No.: 17/488,669

(22) Filed: Sep. 29, 2021

(65) Prior Publication Data

US 2022/0128048 A1 Apr. 28, 2022

Related U.S. Application Data

(63) Continuation of application No. 14/733,481, filed on Jun. 8, 2015, now abandoned.

(Continued)

(51) Int. Cl.
*F04B 9/123* (2006.01)
*F04B 43/073* (2006.01)

(Continued)

(52) U.S. Cl.
CPC ..... *F04B 9/123* (2013.01); *F04B 9/127* (2013.01); *F04B 43/06* (2013.01); *F04B 43/073* (2013.01);

(Continued)

(58) Field of Classification Search
CPC ..... F04B 9/123; F04B 9/127; F04B 43/06; F04B 43/073; F04B 45/053;

(Continued)

(56) References Cited

U.S. PATENT DOCUMENTS 2,920,575 A 1/1960 White et al.
3,699,846 A 10/1972 Stomper (Continued)

FOREIGN PATENT DOCUMENTS

| | | |
|---|---|---|
| JP | 2005121013 | 12/2005 |
| WO | 9610534 | 4/1996 |
| WO | 2013155079 | 10/2013 |

OTHER PUBLICATIONS manitowocbeverage.com "HeavyDuty Advantage BIB Gas Pump" http://www.manitowocbeverage.com/asset/?id=zzqng. 911-532 Rev. A 03/02 which also includes Shurflow' Juice Gas pump 166-200-XX (green label) Installation adn Operation Manual, 911-437 Rev. F 1/98 pp. 1-6; and Shurflow Condiment Gas pump 166-200-XX, Installation and Operation Manual, 911-432 Rev E. 9/03 ECO 7509, pp. 1-4. Mar. 2002.

(Continued)

*Primary Examiner* — Peter J Bertheaud
(74) *Attorney, Agent, or Firm* — Ware, Fressola, Maguire & Barber LLP

(57) ABSTRACT

A pump includes a liquid housing having a liquid chamber with a piston/diaphragm assembly arranged therein that responds to a suction stroke and draws liquid into the liquid chamber, and responds to a pressure stroke and provides liquid from the liquid chamber; and a gas housing having a slide valve assembly separating first and second gas chambers. The slide valve assembly responds to a suction-to-pressure-force at the suction stroke conclusion, changes from a suction-to-pressure stroke state, provides gas from the first to second gas chamber through the slide valve assembly, and provides the pressure stroke so liquid passes from the liquid chamber; and responds to a pressure-to-suction-force at the pressure stroke conclusion, changes from the pressure-to-suction stroke state, provides gas from (Continued)

Single Piston Fountain BIB Pump – Major Component Layout the second chamber through the slide valve assembly, and provides the suction stroke so liquid is drawn into the liquid chamber.

17 Claims, 8 Drawing Sheets

Related U.S. Application Data

(60) Provisional application No. 62/008,782, filed on Jun. 6, 2014.

(51) Int. Cl.

| | |
|---|---|
| ***F04B 45/053*** | (2006.01) |
| ***F04B 53/10*** | (2006.01) |
| ***F04B 43/06*** | (2006.01) |
| ***F04B 9/127*** | (2006.01) |
| ***F04B 9/135*** | (2006.01) |

(52) U.S. Cl.
CPC ..... *F04B 45/053* (2013.01); *F04B 45/0536* (2013.01); *F04B 53/109* (2013.01); *F04B 53/1092* (2013.01); *F04B 9/135* (2013.01); *F04B 43/0736* (2013.01)

(58) Field of Classification Search
CPC ..... F04B 45/0536; F04B 53/109; F04B 53/1092; F04B 9/135; F04B 43/0736
See application file for complete search history.

(56) References Cited

U.S. PATENT DOCUMENTS

| | | | | |
|---|---|---|---|---|
| 3,771,907 | A | 11/1973 | Neumann et al. | |
| 3,782,863 | A | 1/1974 | Rupp | |
| 4,008,984 | A | 2/1977 | Scholle | |
| 4,436,493 | A | 3/1984 | Credle, Jr. | |
| 4,540,349 | A | 9/1985 | Du | |
| 4,681,518 | A | 7/1987 | Credle, Jr. | |
| 4,828,465 | A | 5/1989 | Credle, Jr. | |
| 5,083,906 | A * | 1/1992 | Du | F01L 31/02 417/395 |
| 5,470,209 | A | 11/1995 | Hartley et al. | |
| 5,664,940 | A | 9/1997 | Du | |
| 5,667,105 | A | 9/1997 | Hartley et al. | |
| 5,833,439 | A * | 11/1998 | Du | F04B 43/0736 91/347 |
| 6,234,349 | B1 | 5/2001 | Bilskie et al. | |
| 7,225,830 | B1 | 6/2007 | Kershaw | |
| 8,162,294 | B2 | 4/2012 | Scott | |
| 2005/0072800 | A1 | 4/2005 | Smith | |
| 2009/0126581 | A1 | 5/2009 | Bongers et al. | |
| 2010/0176147 | A1 | 7/2010 | Segers | |
| 2012/0138632 | A1 | 6/2012 | Li et al. | |
| 2013/0209280 | A1 | 8/2013 | Fritsch et al. | |
| 2014/0072455 | A1 | 3/2014 | Du | |

OTHER PUBLICATIONS flojel.com "T5000 Series CO2 Operated Bag-In-Box Pump" https://www.xylemflowcontrol.com/files/T5000_SS_950-0146.pdf. 950-0146 Rev B. 1/12; Jan. 2012.

JP2005121013 English Language Abstract (2 pages); Dec. 5, 2005.

* cited by examiner

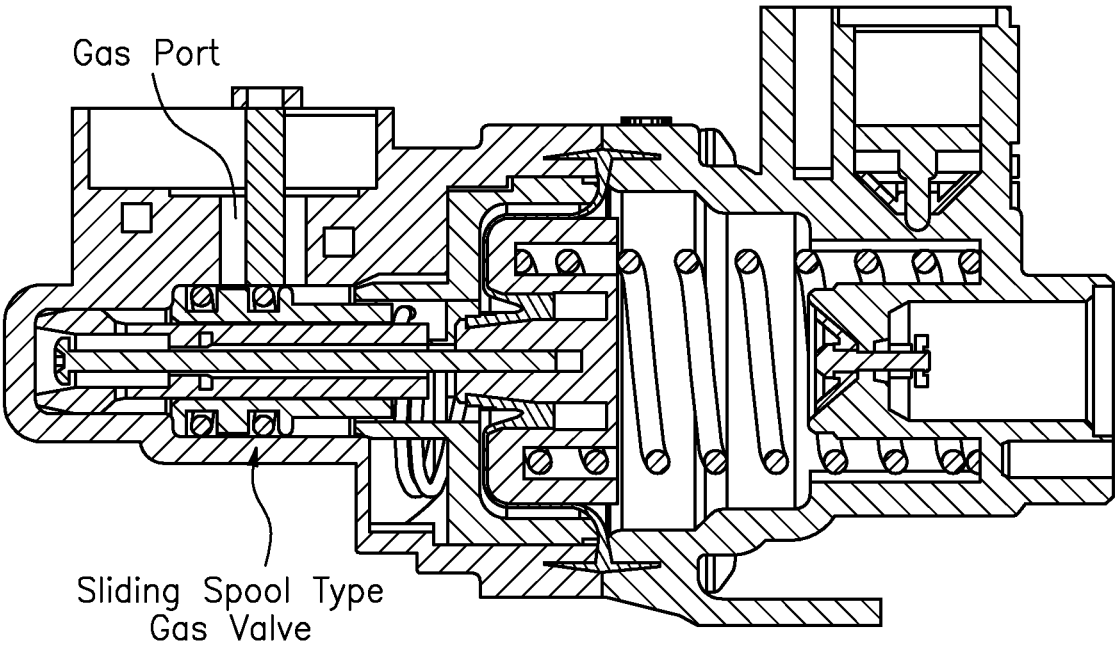
*FIG. 1*: Single Position Fountain BIB Pump
(Prior Design)

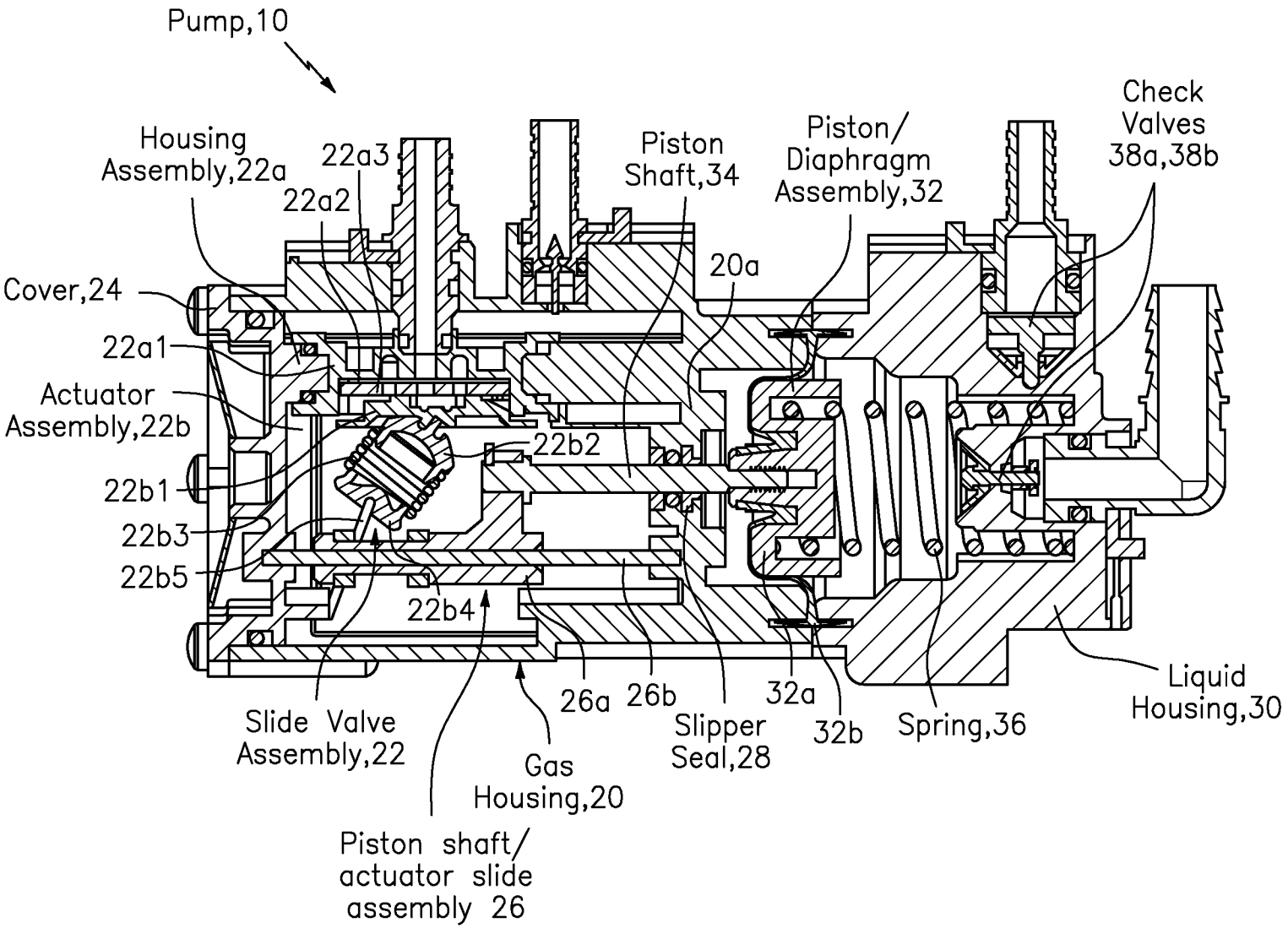
*FIG. 2A*: Single Piston Fountain BIB Pump – Major Component Layout

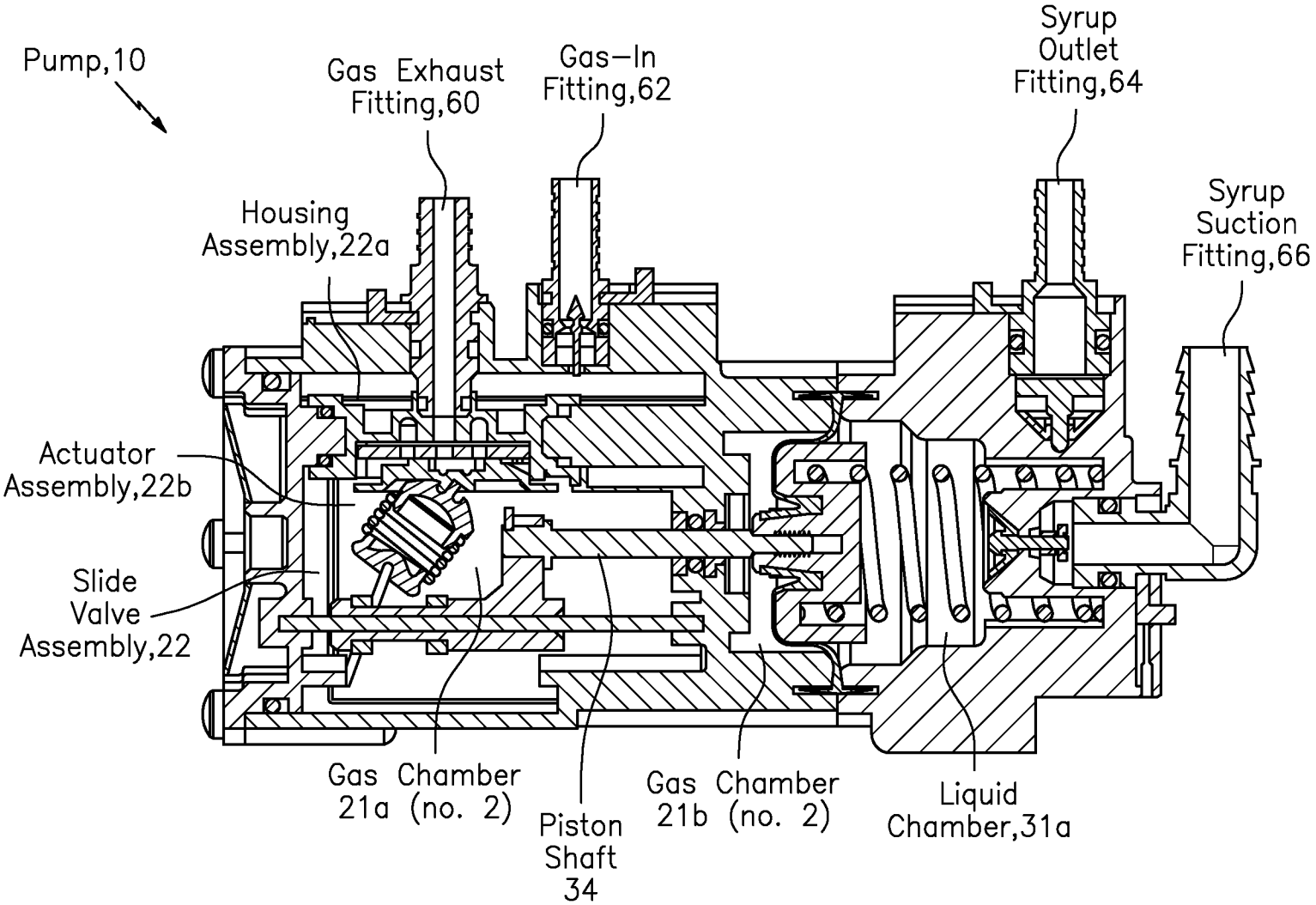
*FIG. 2B*: Single Piston Fountain BIB Pump – Porting and Fluid Areas

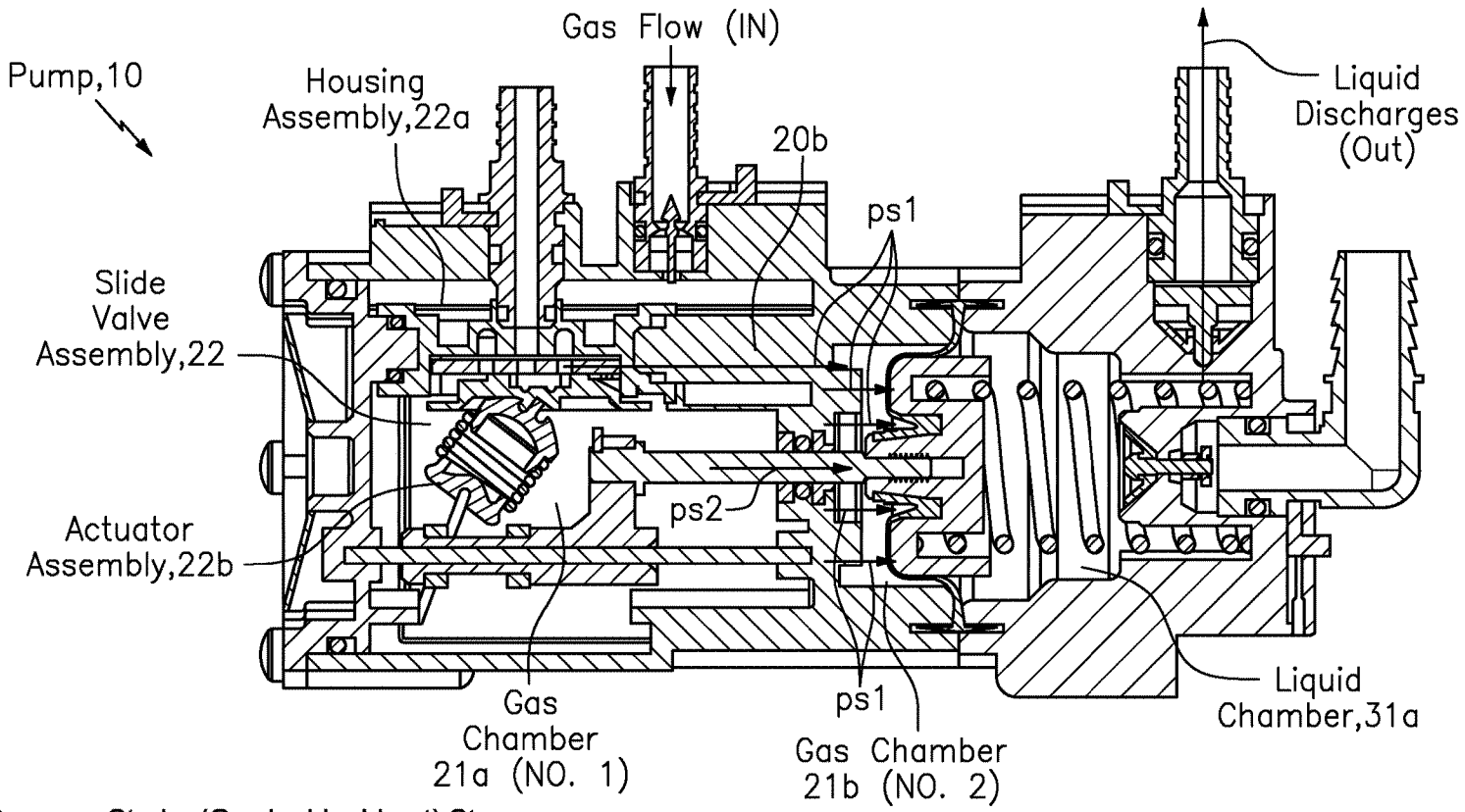

Pressure Stroke (Gas in, Liquid out) Steps:

1. Gas fills the gas chamber #1 via the gas inlet fitting 62.
2. Gas is then routed thru the slide valve assembly 22 (see arrows ps1) to the second gas chamber 21b (no. 2).
3. As gas fills the second chamber 21b (no. 2) pressure acts on the piston/diaphragm 32 causing travel to the right as shown (see arrows ps2)
4. As the piston 32a travels rightward, the contents of the liquid chamber 31a are displaced thru the check valve 38a and out the syrup outlet fitting 64. In addition, the spring 36 is compressed storing energy for the suction stroke.

*FIG. 3*: Single Piston Fountain BIB Pump, Fluid Flow – Pressure Stroke

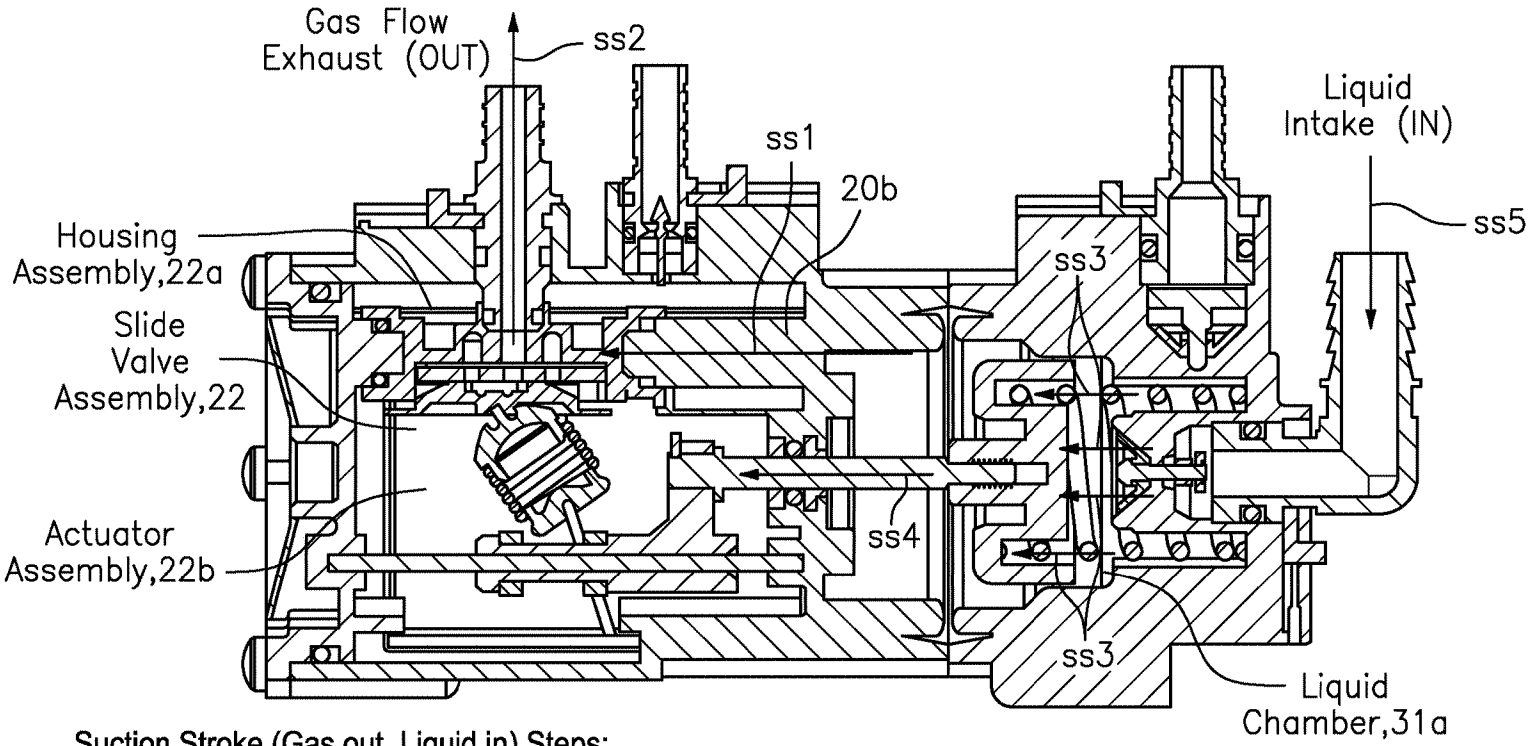

Suction Stroke (Gas out, Liquid in) Steps:

1. At the end of the pressure stroke, the slide valve assembly 22 changes state and the gas in the chamber 21b (no. 2) is routed thru the slide valve assembly 22 (see arrow ss1) and out to atmosphere via gas exhaust fitting 60 (see arrows ss2).
2. The pressure in the second gas chamber 21b (no. 2) drops quickly to zero and the spring 36 acts on the piston/diaphragm 32 (see arrows ss3) inducing travel leftward.
3. As the piston/diaphragm 32 travels leftwards (see arrow ss4), the liquid chamber 31a is expanded drawing fluid into the liquid chamber 31a (see arrow ss5) thru the check valve 38b.
4. At the conclusion of the suction stroke, then entire mechanism will change to the pressure stroke (see fig 3c)

*FIG. 4*: Single Piston Fountain BIB Pump, Fluid Flow – Suction Stroke

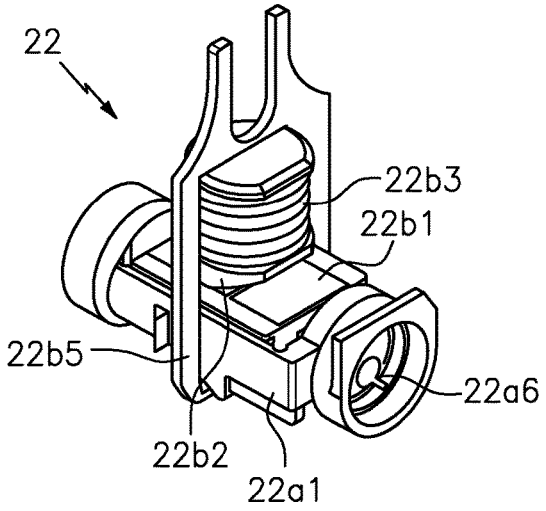
FIG. 5A
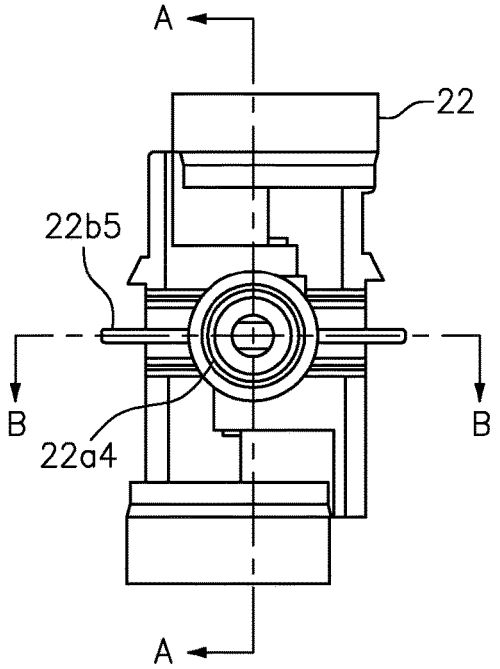
FIG. 5B
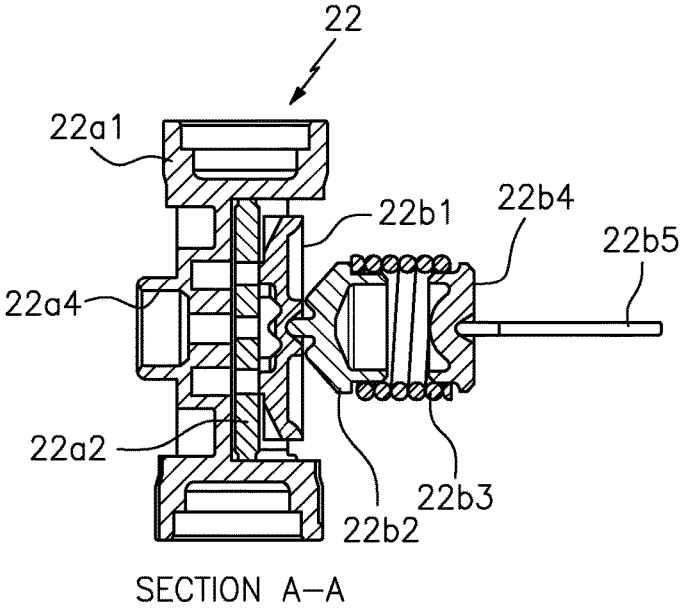
FIG. 5C
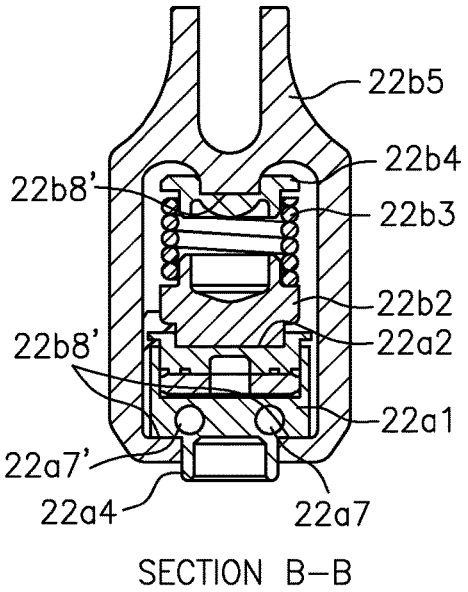
FIG. 5D
FIG. 5

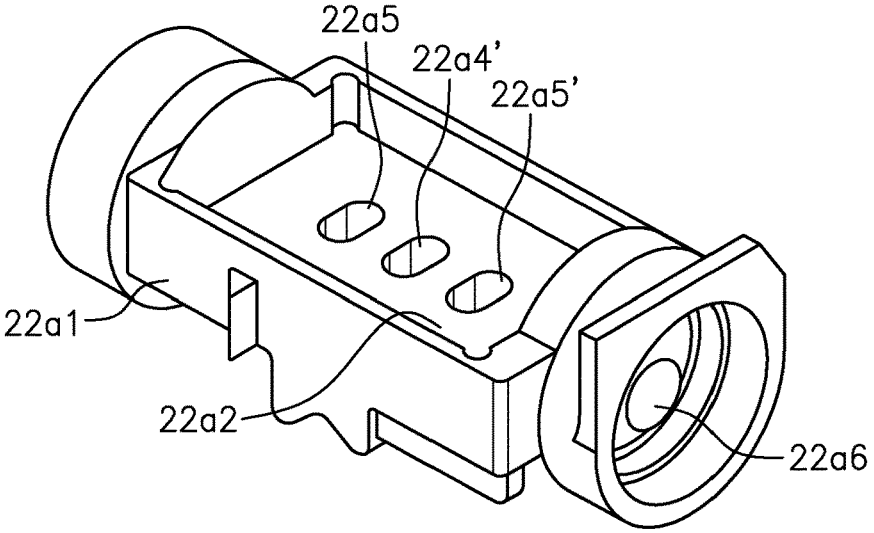
FIG. 6A
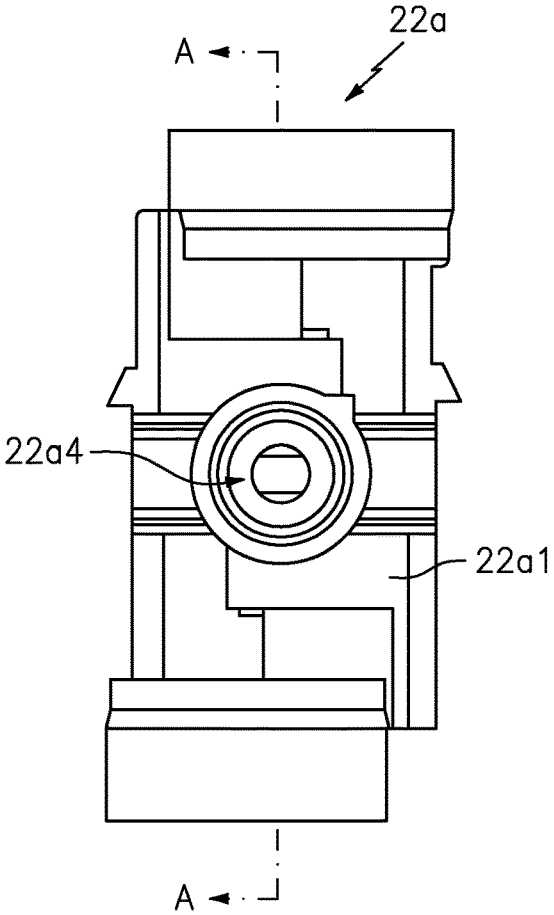
FIG. 6B
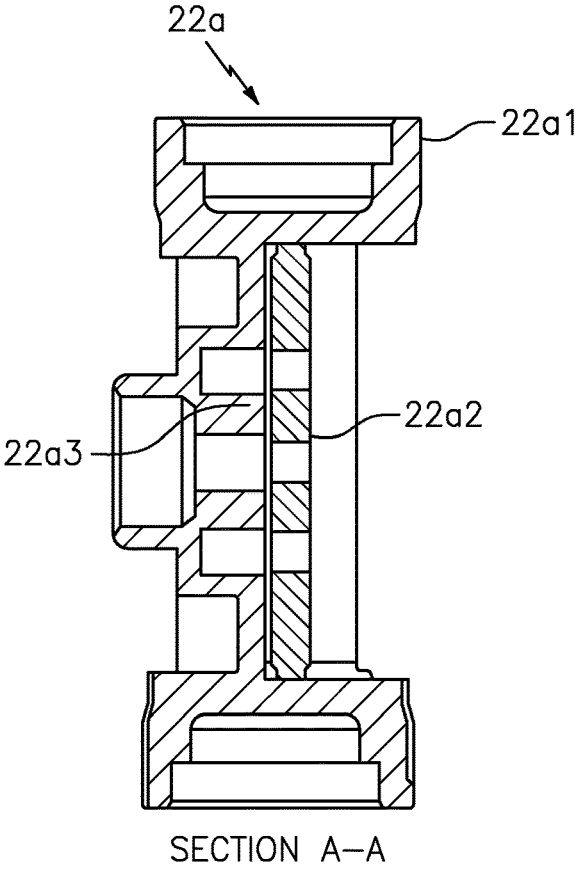
FIG. 6C
FIG. 6

SINGLE PISTON FOUNDATION BAG-IN-BOX (BIB) PUMP

CROSS-REFERENCE TO RELATED APPLICATIONS

This application is a continuation application of, and claims benefit to, patent application Ser. No. 14/733,481, filed 8 Jun. 2015, which claims benefit to provisional patent application Ser. No. 62/008,782 (911-005-074-1 (FFLJX0010US)), filed 6 Jun. 2014; which is incorporated by reference in its entirety.

BACKGROUND OF THE INVENTION

1. Field of Invention

The present invention relates to a pump; and more particularly to a pump for controlling the provisioning of syrup from a syrup bag to a fluid dispenser.

2. Description of Related Art

Pumps are known in the art that are air-driven double piston/diaphragm pumps such as the model G & N series BIB pumps that are distributed by the assignee of the present invention. Problems and shortcomings of these known pumps include that they require more parts and more space than is otherwise needed to provide the required output or pumping. For the required output (which is relatively small), these pumps are over rated and therefore not an ideal solution in terms of cost and space. FIG. 1 shows an existing product offering having a spool type gas valve that has been in existence for more than 15 years.

There is a need in the industry to provide a solution to the aforementioned problem in terms of cost and space.

SUMMARY OF THE INVENTION

The present invention provide a single piston diaphragm pump that provides a solution to the aforementioned problem in the art in terms of cost and space.

By way of example, and according to some embodiments, the present invention may include, or take the form of, apparatus such as a pump featuring a liquid housing configured with a liquid chamber in combination a gas housing configured with a gas chamber.

The liquid chamber may be configured with a single piston/diaphragm assembly arranged therein to respond to a suction stroke and draw liquid into the liquid chamber, and configured to respond to a pressure stroke and provide the liquid from the liquid chamber.

The gas housing may include a slide valve assembly that fluidicly communicates with a first gas chamber and a second gas chamber. The slide valve assembly may be configured to respond to a suction-to-pressure stroke force at a conclusion of the suction stroke, change from a suction stroke state to a pressure stroke state, provide gas from the first gas chamber to the second gas chamber through the slide valve assembly, and provide the pressure stroke so the liquid passes from the liquid chamber. The slide valve assembly may also be configured to respond to a pressure-to-suction stroke force at a corresponding conclusion of the pressure stroke, change from the pressure stroke state to the suction stroke state, provide gas from the second gas chamber to atmosphere through the slide valve assembly, and provide the suction stroke so the liquid is drawn into the liquid chamber.

The present invention may include one or more of the following features:

The slide valve assembly may include a block or housing assembly and an actuator assembly; the block or housing assembly may include a slide valve housing configured with a cavity, recess or channel; and the actuator assembly may include a slide block configured to slide in the cavity, recess or channel of the slide valve housing, an actuator combination having a slide spring arranged between a lower retainer and an upper retainer, and a yoke configured with an opening to contain the actuator combination under compression and also configured to couple to the slide valve housing allowing the slide valve assembly to change between the pressure stroke state and the suction stroke state respectively in response to the suction-to-pressure force and the pressure-to-suction force.

The actuator assembly may be configured to slide, rotate or translate in relation to the block or housing assembly in response to the suction-to-pressure force and the pressure-to-suction force.

The first gas chamber may be configured to receive the gas via a gas-in fitting in response to the suction-to-pressure force at the conclusion of the suction stroke.

The valve slide assembly may be configured to provide the gas via a gas exhaust fitting to atmosphere in response to the pressure-suction force at the conclusion of the pressure stroke.

During the pressure stroke, the valve slide assembly may be positioned so that gas is routed from the first gas chamber thru the slide valve assembly to the second gas chamber.

During the suction stroke, the valve slide assembly may be positioned so that gas is routed from the second gas chamber thru the slide valve assembly to a gas exhaust fitting, then to atmosphere.

The single piston/diaphragm assembly may be configured to respond to the gas filling the second gas chamber, provide the pressure stroke causing a displacement of the liquid from the liquid chamber through an outlet fitting, and cause the slide valve assembly to change from the pressure stroke state to the suction stroke state at the conclusion of the pressure stroke.

The single piston/diaphragm assembly may be configured to respond to the gas being exhausted from the second chamber, provide the suction stroke, draw the liquid through a liquid inlet fitting and into the liquid chamber, and cause the slide valve assembly to change from the suction stroke state to the pressure stroke state at the conclusion of the suction stroke.

The single piston/diaphragm assembly may include a spring configured to respond to the pressure stroke, compress storing energy for the suction stroke, and provide the suction stroke at the corresponding conclusion of the pressure stroke.

The single piston/diaphragm assembly may be configured between the second gas chamber and the liquid chamber to respond to the suction stroke and move so as to expand the volume of the liquid chamber drawing fluid into the liquid chamber.

The slide valve assembly may include at least one component made of ceramic. By way of example, the slide block may be made of ceramic.

The single piston/diaphragm assembly may include a piston and a diaphragm, the piston being coupled to the slide valve assembly via a piston shaft/actuator slide assembly, and the diaphragm being coupled between the gas housing and the liquid housing.

Possible applications may include, e.g., bag-in-box fluid transfer, bottled water dispensers, coffee machine auto-refill, beverage dispensers, general fluid transfer, water pressure systems, or chemical spraying systems.

BRIEF DESCRIPTION OF THE DRAWING

The drawing includes FIGS. 1-6, which are not necessarily drawn to scale, as follows:

FIG. 1 is a diagram of a single piston fountain Bag-in-Box (BIB) pump that is known in the art.

FIG. 2A is diagram of a cross-section of a single piston fountain Bag-in-Box (BIB) pump showing and identifying a major component layout, according to some embodiments of the present invention.

FIG. 2B is diagram of a cross-section of a single piston fountain Bag-in-Box (BIB) pump showing and identifying porting and fluid areas, according to some embodiments of the present invention.

FIG. 3 is diagram of a cross-section of a single piston fountain Bag-in-Box (BIB) pump showing and identifying fluid flow (e.g., gas and liquid flow) in relation to a pressure stroke, according to some embodiments of the present invention.

FIG. 4 is diagram of a cross-section of a single piston fountain Bag-in-Box (BIB) pump showing and identifying fluid flow (e.g., gas and liquid flow) in relation to a suction stroke, according to some embodiments of the present invention.

FIG. 5 includes FIGS. 5A to 5D, where FIG. 5A is a top perspective view of the slide valve assembly, FIG. 5B is a bottom plan view of the slide valve assembly in FIG. 5A, FIG. 5C is a cross-section view along lines A-A of the slide valve assembly show in FIG. 5B, and FIG. 5D is a cross-section view along lines B-B of the slide valve assembly show in FIG. 5B, all according to some embodiments of the present invention.

FIG. 6 includes FIGS. 6A to 6C, where FIG. 6A is a top perspective view of the block or housing assembly, FIG. 6B is a bottom plan view of the block or housing assembly in FIG. 6A, and FIG. 6C is a cross-section view along lines A-A of the block or housing assembly show in FIG. 6B, all according to some embodiments of the present invention.

Figure 7A:
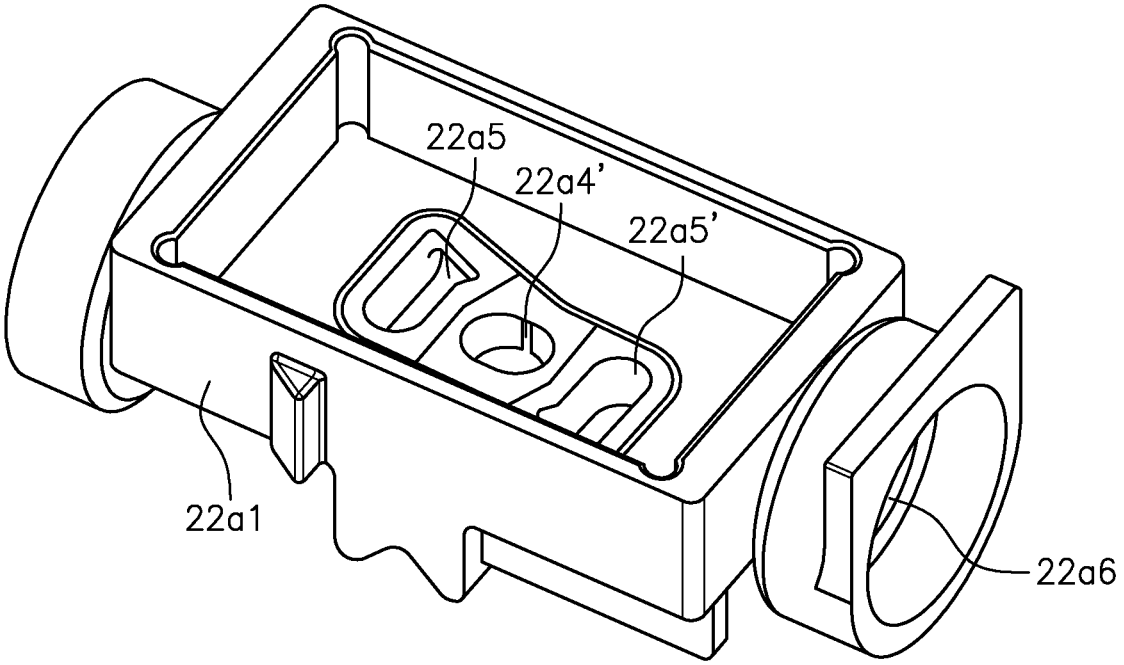
FIG. 7A is a top perspective view of the block or housing assembly.

In the drawing, the Figures have reference numerals and lead lines associated with the various elements shown therein. For the sake of reducing clutter in the drawing, and also improving readability when the specification is read in conjunction with the drawing, every Figure does not include every reference numeral and lead line associated with every element shown therein. Moreover, as a person skilled in the art would appreciate, some elements that do not form part of the underlying point of novelty of the present invention are not provided with a reference numeral and lead line.

DETAILED DESCRIPTION OF BEST MODE OF THE INVENTION

FIGS. 2A, 2B, 3 and 4 show the present invention in the form of a pump generally indicated as 10.

FIG. 2A

FIG. 2A shows the major component layout of the pump 10 that includes the gas housing 20 and a liquid housing 30.

By way of example, inside the gas housing 20, the following components may be arranged: a slide valve assembly 22 configured therein, a gas housing cover 24, and a piston shaft/actuator slide assembly 26. The slide valve assembly 22 may be configured with a block or housing assembly 22*a* and an actuator assembly 22*b*. The block or housing assembly 22*a* may include a slide valve housing 22*a*1, a block plate 22*a*2 and a gasket block 22*a*3, as labeled in FIG. 2A. The block or housing assembly 22*a* may also includes a gas opening 22*a*4, a gas opening 22*a*4', a gas openings 22*a*5, a gas openings 22*a*5', a gas opening 22*a*6, a gas opening 22*a*6', and a gas channel or passageway 22*a*7, a gas channel or passageway 22*a*7', which are all shown and labeled in relation to FIGS. 5 and 6.

As labeled in FIG. 2A, the actuator assembly 22*b* may include a slide block 22*b*1, a lower retainer 22*b*2, a slide spring 22*b*3, an upper retainer 22*b*4 and a yoke 22*b*5, which are all shown in further detail in FIG. 5. (By way of example, reference label 22*b*8 (FIG. 5D) indicates where the application of a lubricant, such as a silicon lubrication, may be applied.) The gas housing 20 may also be configured with two gas chamber 21*a*, 21*b*, which are labeled and identified in FIG. 2B. The piston/actuator slide assembly 26 may include a piston shaft coupling member 26*a* that slides along an actuator slide 26*b* as the slide valve assembly 22 slides back and forth (i.e., from left to right) when moving from the pressure stroke (FIG. 3) to the suction stroke (FIG. 4), and vice versa. The actuator slide 26*b* may be mounting between suitable portions of the gas housing 20, e.g., consistent with that shown in FIGS. 2A, 2B, 3 and 4.

By way of example, inside the liquid housing 30, the following components may be arranged: a piston/diaphragm assembly 32, a piston shaft 34, a spring 36 and check valves 38*a*, 38*b*. The piston/diaphragm assembly 32 may include a piston 32*a* and a diaphragm 32*b*, as labeled in FIG. 2A. (The diaphragm 32*b* is shown in FIGS. 2A, 2B and 3, but not shown in FIG. 4). The piston shaft 34 may be coupled on one end to the piston support member 26*a*, and may be coupled on the other end to the piston 32*a*, as shown. The diaphragm 32*b* may be coupled between the gas housing 20 and the liquid housing 30, as shown in FIGS. 2A, 2B and 3. A slipper seal 28 may be configured between part 20*a* of the gas housing 20 and the piston shaft 34 between gas chambers 21*a*, 21*b* (e.g., see FIG. 2A).

FIG. 2B

FIG. 2B shows the porting and fluid areas of the pump 10 that includes a gas exhaust fitting 60, a gas-in fitting 62, a syrup outlet fitting 64 and a syrup suction fitting 66. FIG. 2B also shows and identifies the gas chamber 21*a* (No. 1), the gas chamber 21*b* (No. 2) and a liquid chamber 31*a*.

FIG. 3: The Pressure Stroke

FIG. 3 shows the pump 10 during a pressure stroke, i.e. when gas flows into the gas chamber 20 causing liquid to flow out of the liquid chamber 31*a* of the pump 10.

By way of example, FIG. 3 shows steps of the pressure stroke, as follows:

1. Gas fills the first gas chamber 21*a* (no. 1) via the gas inlet fitting 62 (FIG. 2B).

2. Gas is then routed thru the slide valve assembly 22 (see arrows ps1) from the first gas chamber 21*a* to the second gas chamber 21*b* (no. 2). In operation, the actuator assembly 22*a* is positioned to allow the gas to pass from the gas chamber 21*a* (no. 1) to the gas chamber 21*b* (no. 2), e.g., via a gas housing passage or channel that may be formed into part 20*b* of gas housing 20 (indicated by the flow using arrow ps1). By way of example, when the slide valve assembly 22 slides, rotates or translates into the position shown in FIG. 3, the slide block 22*b*1 is configured to allow gas to flow from the first gas chamber 21*a* through the valve slide housing 22*a*1, through the gas opening 22*a*5 (FIGS. 7A, 7B), through the gas housing passage or channel 22*a*7 (FIG. 7B), out gas opening 22*a*6, through the gas housing passage or channel in the gas housing 20, and into the second gas chamber 21*b* as indicated by arrow ps1. In effect, when the slide block 22*b*1 is in the position in FIG. 3, part of the slide block 22*b*1 is blocking the middle gas opening 22*a*4', so the gas cannot flow through the gas opening 22*a*4' (FIG. 7A, 7B) and out via the gas opening 22*a*4 (FIG. 5D, 6B) to the gas exhaust fitting 60.
3. As gas fills the second gas chamber 21*b* (no. 2), pressure acts on the piston/diaphragm 32 (FIG. 2A) causing it to travel to the right as shown (see arrow ps2).
4. As the piston 32*a* travels rightward, the liquid contents of the liquid chamber 31*a* are displaced through the check valve 28*a* and discharged out the liquid/syrup outlet fitting 64. In addition, the spring 36 is compressed storing energy for the suction stroke shown and described in relation to FIG. 4.

FIG. 4: The Suction Stroke

FIG. 4 shows the pump 10 during a suction stroke, i.e. gas flowing out from the pump 10 and liquid flowing into of the pump 10. By way of example, FIG. 4 shows steps of the suction stroke, as follows:

1. At the end of the pressure stroke, the slide valve assembly 22 slides, rotates to translates into the position shown in FIG. 4, the slide block 22*b*1 changes state, and the gas in the second gas chamber 21*b* (no. 2) is routed back thru the gas housing passage or channel in the part 20*b* of the gas housing 20, through the slide valve assembly 22 (see arrow ss1), through the gas opening 22*a*4' (FIG. 7A or 7B), out the gas opening 22*a*4 (FIG. 5B or 6B) and out the gas exhaust fitting 60, e.g., to atmosphere (as gas flow exhaust, see arrows ss2). In effect, when the slide block 22*b*1 is in the position in FIG. 4, part of the slide block 22*b*1 is blocking the gas opening 22*a*5, so gas is not flowing from the second gas chamber 21*b* back into the first gas chamber 21*a*.
2. The pressure in the second gas chamber 21*b* (no. 2) drops quickly to zero and the spring 36 acts on the piston/diaphragm 32 (see arrows ss3) inducing travel leftward.
3. As the piston/diaphragm 32 travels leftwards (see arrow ss4), the liquid chamber 31*a* is expanded drawing liquid (e.g., syrup) via the syrup suction fitting 66 into the liquid chamber 31*a* (see arrow ss5) thru the check valve 38*b*.
4. At the conclusion of the suction stroke, then the entire mechanism will change to the pressure stroke (see FIG. 3), i.e., the slide valve assembly 22 slides, rotates or translates into the position shown in FIG. 3, the slide block 22*b*1 changes state back to that shown in FIG. 3C.

The Actuator Assembly 22*b*

In the actuator assembly 22*b*, the slide spring 22*b*3 is configured under compression between the lower and upper retainers 22*b*2 and 22*b*4, and in relation to the sliding block 22*a*1 and the yoke 22*b*5, e.g., when in either the position in the pressure stroke (FIG. 3) or the position in the suction stroke (FIG. 4). When the actuator assembly 22*b* rotates or translates from the position in the pressure stroke (FIG. 3) to the position in the suction stroke (FIG. 4), or vice versa, the slide spring 22*b*3 is further compressed, then relaxes once the actuator assembly 22*b* has fully rotated or translated back to the position in the other position. In effect, the slide spring 22*b*3 provides the resilience or elasticity to allow the rotation or translation back and forth between the positions in FIGS. 3 and 4.

A Ceramic Slide Type Gas Valve 22*b*

By way of example, the slide valve assembly 22 may include one or more components made of ceramic. For example, the slide block or gas valve 22*b*1 may include, or take the form of, a ceramic slide type gas valve. As a person skilled in the art would appreciate, a ceramic may take the form of a product or an article of manufacture made from a nonmetallic material by firing at a high temperature, such as porcelain. In particular, porcelain may be made from, or consistent of, kaolin, quartz and/or feldspar that is fired at high temperatures. The scope of the invention is not intended to be limited to any particular type or kind of ceramic or ceramic material that is now known or later developed in the art.

Figure 7B:
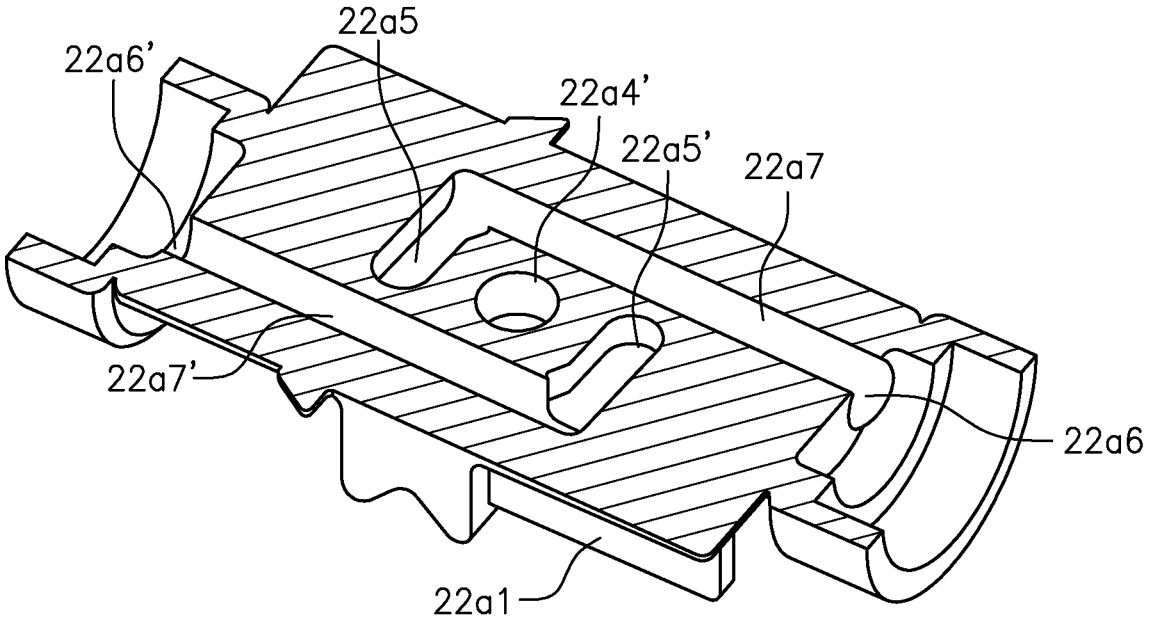
FIG. 7B is a cross-sectional view of the block or housing assembly in FIG. 7A, all according to some embodiments of the present invention.

FIGS. 7A and 7B

FIGS. 7A and 7B show the gas opening 22*a*5', the gas opening 22*a*6' and the gas channel 22*a*7'. These openings and channel are closed off in a single pump configuration like that shown in FIGS. 2A, 2B 3 and 4, but and may be used in a two pump configuration. For example, in the embodiments shown in relation to FIGS. 2A, 2B, 3 and 4, either the slide block 22*b*1 blocks the gas opening 22*a*5' when the slide block 22*b*1 is in the positions in FIGS. 3 and 4, or the gas opening 22*a*6' is blocked off, e.g., with a cap (not shown).

Applications

By way of example, possible applications may include: BIB pumping, transfer pumping, or beverage dosing.

The present invention may also be used in, or form part of, or used in conjunction with, other fluid handling applications. The scope of the invention is also not intended to be limited to being implemented in any particular type or kind of pump either now known or later developed in the future, and may include other diaphragm pumps, etc.

The Scope of the Invention

While the invention has been described with reference to an exemplary embodiment, it will be understood by those skilled in the art that various changes may be made and equivalents may be substituted for elements thereof without departing from the scope of the invention. In addition, may modifications may be made to adapt a particular situation or material to the teachings of the invention without departing from the essential scope thereof. Therefore, it is intended that the invention not be limited to the particular embodiment(s) disclosed herein as the best mode contemplated for carrying out this invention.

What is claimed is:

1. A pump (10) comprising:

a gas housing (20) having a first gas chamber (21*a*), a second gas chamber (21*b*), a gas exhaust fitting (60) configured to provide inlet gas to the first gas chamber (21*a*), and a gas inlet fitting (62) configured to provide outlet gas from the second gas chamber (21*b*), a liquid housing (30) having a liquid chamber (31*a*), a liquid outlet fitting (64) configured to provide liquid from the liquid chamber (31*a*), and a liquid suction fitting (66) configured to provide the liquid to the liquid chamber (31*a*), having a single piston/diaphragm assembly (32) with a spring (36) and being arranged between the second gas chamber (21*b*) and the liquid chamber (31*a*), the single piston/diaphragm assembly (32) drawing the liquid from the liquid inlet fitting (66) into the liquid chamber (31*a*) during a suction stroke and providing the liquid from the liquid chamber (31*a*) to the outlet fitting (64) during a pressure stroke; the spring (36) being configured in the liquid chamber (31*a*) to store energy during the pressure stroke and provides the suction stroke; and a slide valve assembly (22) being arranged in the first gas chamber 21*a* and being movable between a pressure stroke state and a suction stroke state for alternately providing pressurized gas to the second gas chamber (21*b*) so that the liquid passes from the liquid chamber (31*a*) to the liquid outlet fitting (64), and providing gas from the second gas chamber (21*b*) to atmosphere, so that the spring (36) provides the suction stroke and liquid is drawn from the liquid inlet fitting (66) into the liquid chamber (31*a*), characterized in that the slide valve assembly (22) comprises a block or housing assembly (22*a*) and an actuator assembly (22*b*);

the block or housing assembly (22*a*) comprises a slide valve housing (22*a*1) configured with a cavity;

the actuator assembly (22*b*) comprises a slide block (22*b*1) configured to slide in the cavity of the slide valve housing (22*a*1);

the actuator assembly (22*b*) having a slide spring (22*b*3) arranged between a lower retainer (22*b*2) and an upper retainer (22*b*4) forming an actuator combination under compression, and a yoke (22*b*5) configured with an opening to contain the actuator combination under compression; and a piston shaft/actuator slide assembly (26) coupling the yoke (22*b*5) and the single piston/diaphragm assembly (32) causing the slide valve assembly (22) to change between the pressure stroke state and the suction stroke state.

2. A pump (10) according to claim 1, wherein the actuator assembly (22*b*) is configured to slide in relation to the block or housing assembly (22*a*) in response to the suction-to-pressure force and the pressure-to-suction force.

3. A pump (10) according to claim 1, wherein the first gas chamber (21*a*) is configured to receive the gas via the gas inlet fitting (62) in response to the suction-to-pressure force at the conclusion of the suction stroke.

4. A pump (10) according to claim 1, wherein the slide valve assembly (22) is configured to provide the gas via the gas exhaust fitting (60) to atmosphere in response to the pressure-suction force at the conclusion of the pressure stroke.

5. A pump (10) according to claim 1, wherein, during the pressure stroke, the slide valve assembly (22) is positioned so that gas is routed from the first gas chamber (21*a*) thru the slide valve assembly (22) to the second gas chamber (21*b*).

6. A pump (10) according to claim 1, wherein, during the suction stroke, the slide valve assembly (22) is positioned so that gas is routed from the second gas chamber (21*b*) thru the slide valve assembly (22) to the gas exhaust fitting (60).

7. A pump (10) according to claim 1, wherein the slide valve assembly (22) comprises at least one component (22*b*) made of ceramic.

8. A pump (10) according to claim 7, wherein the slide block (22*b*1) is made of ceramic.

9. A pump (10) according to claim 2, wherein the single piston/diaphragm assembly (32) comprises a piston (32*a*) and a diaphragm (32*b*), the piston (32*a*) being coupled to the slide valve assembly (22) via a piston shaft/actuator slide assembly (26), and the diaphragm (32*b*) being coupled between the gas housing (20) and the liquid housing (30).

10. A pump (10) comprising:

a gas housing (20) having a first gas chamber (21*a*), a second gas chamber (21*b*), a gas exhaust fitting (60) configured to provide inlet gas to the first gas chamber (21*a*), and a gas inlet fitting (62) configured to provide outlet gas from the second gas chamber (21*b*);

a liquid housing (30) having a liquid chamber (31*a*), a liquid outlet fitting (64) configured to provide liquid from the liquid chamber (31*a*), and a liquid suction fitting (66) configured to provide the liquid to the liquid chamber (31*a*), having a single piston/diaphragm assembly (32) with a spring (36) and being arranged between the second gas chamber (21*b*) and the liquid chamber (31*a*), the single piston/diaphragm assembly (32) drawing the liquid from the liquid inlet fitting (66) into the liquid chamber (31*a*) during a suction stroke and providing the liquid from the liquid chamber (31*a*) to the outlet fitting (64) during a pressure stroke; the spring (36) being configured in the liquid chamber (31*a*) to store energy during the pressure stroke and provides the suction stroke; and a slide valve assembly (22) being arranged in the first gas chamber 21*a* and being movable between a pressure stroke state and a suction stroke state for alternately providing pressurized gas to the second gas chamber (21*b*) so that the liquid passes from the liquid chamber (31*a*) to the liquid outlet fitting (64), and providing gas from the second gas chamber (21*b*) to atmosphere, so that the spring (36) provides the suction stroke and liquid is drawn from the liquid inlet fitting (66) into the liquid chamber (31*a*), characterized in that the slide valve assembly (22) comprises a block or housing assembly (22*a*) and an actuator assembly (22*b*);

the block or housing assembly (22*a*) comprises a slide valve housing (22*a*1) configured with a cavity;

the actuator assembly (22*b*) comprises a slide block (22*b*1) configured to slide in the cavity of the slide valve housing (22*a*1);

the actuator assembly (22*b*) having a slide spring (22*b*3) arranged between a lower retainer (22*b*2) and an upper retainer (22*b*4) forming an actuator combination under compression, and a yoke (22*b*5) configured with an opening to contain the actuator combination under compression;

a piston shaft/actuator slide assembly (26) coupling the yoke (22*b*5) and the single piston/diaphragm assembly (32) causing the slide valve assembly (22) to change between the pressure stroke state and the suction stroke state; and the single piston/diaphragm assembly (32) comprises a piston (32*a*) and a diaphragm (32*b*), the piston (32*a*) being coupled to the slide valve assembly (22) via a piston shaft/actuator slide assembly (26), and the diaphragm (32*b*) being coupled between the gas housing (20) and the liquid housing (30).

11. A pump (10) according to claim 10, wherein the actuator assembly (22*b*) is configured to slide in relation to the block or housing assembly (22*a*) in response to the suction-to-pressure force and the pressure-to-suction force.

12. A pump (10) according to claim 10, wherein the first gas chamber (21*a*) is configured to receive the gas via the gas inlet fitting (62) in response to the suction-to-pressure force at the conclusion of the suction stroke.

13. A pump (10) according to claim 10, wherein the slide valve assembly (22) is configured to provide the gas via the gas exhaust fitting (60) to atmosphere in response to the pressure-suction force at the conclusion of the pressure stroke.

14. A pump (10) according to claim 10, wherein, during the pressure stroke, the slide valve assembly (22) is positioned so that gas is routed from the first gas chamber (21*a*) thru the slide valve assembly (22) to the second gas chamber (21*b*).

15. A pump (10) according to claim 10, wherein, during the suction stroke, the slide valve assembly (22) is positioned so that gas is routed from the second gas chamber (21*b*) thru the slide valve assembly (22) to the gas exhaust fitting (60).

16. A pump (10) according to claim 10, wherein the slide valve assembly (22) comprises at least one component (22*b*) made of ceramic.

17. A pump (10) according to claim 16, wherein the slide block (22*b*1) is made of ceramic.

* * * * *